US005089846A

United States Patent [19]

Tabuchi

[11] Patent Number: 5,089,846

[45] Date of Patent: Feb. 18, 1992

[54] POSITIONING MEANS FOR A PIVOTALLY MOUNTED ELECTROSTATIC IMAGE FORMING MEANS

[75] Inventor: Hiroshi Tabuchi, Hyogo, Japan

[73] Assignee: Mitsubishi Denki Kabushiki Kaisha, Tokyo, Japan

[21] Appl. No.: 653,321

[22] Filed: Feb. 11, 1991

[30] Foreign Application Priority Data

Aug. 13, 1990 [JP] Japan ..... 2-214107

[51] Int. Cl.[5] ..... G03G 15/00

[52] U.S. Cl. ..... 355/200; 346/155; 355/210

[58] Field of Search ..... 355/200, 202, 210, 211; 346/155, 158, 159, 160.1; 358/296, 300, 298

[56] References Cited

U.S. PATENT DOCUMENTS

| | | | |
|---|---|---|---|
| 4,257,054 | 3/1981 | Ishikawa | 346/155 |
| 4,258,372 | 3/1981 | Ishikawa | 346/155 X |
| 4,849,824 | 7/1989 | Sakuragi et al. | 358/296 |
| 5,005,053 | 4/1991 | Kozuka | 355/200 X |
| 5,006,865 | 4/1991 | Kuroiwa | 358/298 |

FOREIGN PATENT DOCUMENTS

| | | |
|---|---|---|
| 58-139162 | 8/1983 | Japan . |
| 62-58506 | 12/1987 | Japan . |

*Primary Examiner*—A. T. Grimley
*Assistant Examiner*—William J. Royer
*Attorney, Agent, or Firm*—Rothwell, Figg Ernst & Kurz

[57] ABSTRACT

Electrostatic image forming device according to the present invention is contacted with a surface of a photosensitive drum by way of a positioning member so that it may follow the photosensitive drum in any eccentric condition, and consequently, the position thereof relative to the photosensitive drum is maintained constant, and accordingly, a recorded picture of a high quality is obtained. Further, since the relative positions of the electrostatic image forming device and the photosensitive drum are varied by adjustment of the positioning measure in response to opening and closing operation of an electrophotographic apparatus body, electrostatic image forming device having a short focal length can be used, and the overall size of the electrophotographic apparatus body can be reduced.

7 Claims, 3 Drawing Sheets

POSITIONING MEANS FOR A PIVOTALLY MOUNTED ELECTROSTATIC IMAGE FORMING MEANS

BACKGROUND OF THE INVENTION

1. Field of the Invention

This invention relates to an electrophotographic apparatus wherein a plurality of means in an apparatus body are constructed for movement for individual units, and more particularly to an electrophotographic apparatus wherein the distance between a photosensitive drum on a processing unit side and electrostatic image forming means is normally kept constant.

2. Description of the Prior Art

FIG. 1 is a sectional view showing a conventional electrophotographic apparatus. Referring to FIG. 1, reference numeral 1 denotes a photosensitive drum having a photoconductive layer provided on a conductive drum base body, 2 a corona discharger for charging the photosensitive drum 1, 3 an electrostatic image forming means for forming an electrostatic latent image by exposure to light, 4 a developing device, 5 a transfer corona discharger serving as a transfer device for performing transfer of a visible image obtained by development of an image, 6 a cleaning device, 7 a housing, 8 a processing unit wherein the photosensitive drum 1, corona discharger 2, developing device 4 and cleaning device 6 are supported in an integrated relationship on the housing 7, reference characters 9*a* and 9*b* denote guide rails for supporting the processing unit 8 for movement on an electrophotographic apparatus body F, reference numeral 10 denotes a rotary shaft for opening and closing the body of the electrophotographic apparatus, 11 a fixing device, 12 a discharging roller, 13 a separating roller for separating record paper from the photosensitive drum 1, 14 a register roller, 15 a pickup roller, and 16 record paper accommodated in a record paper cassette 17.

Subsequently, the operation will be described. A surface of the photosensitive drum 1 is charged uniformly with a predetermined polarity by the corona discharger 2, and then the photosensitive drum 1 is exposed to light by the electrostatic image forming means 3 to form an electrostatic latent image thereon. The electrostatic latent image formed on the drum 1 is developed into a visible image by the developing device 4. The thus formed visible image is transferred by the transfer corona discharger 5. Record paper sheets 16 accommodated in the record paper cassette 17 are forwarded one by one by rotational movement of the pickup roller 15 and transported to the transfer station by way of the register roller 14. A record paper sheet 16 to which the visible image has been transferred is separated from the photosensitive drum 1 by the separating roller 13 and then sent to the fixing device 11 at which the transferred visible image is fixed to the record paper 16. The record paper 16 is thereafter discharged by the discharging roller 12.

Since the conventional electrophotographic apparatus is constructed in such a manner as described above, the accuracy of the distance between the electrostatic image forming means 3 and the photosensitive drum 1 of the processing unit which is removable from the electrophotographic apparatus body is influenced significantly by the accuracy of parts and the accuracy in assembly, and there is a problem that the quality of a picture is deteriorated significantly particularly by eccentricity of the photosensitive drum 1. Further, in order to removably mount the photosensitive drum 1 in the form of a processing unit, it is necessary to take a sufficient distance to some degree between the electrostatic image forming means 3 and the photosensitive drum 1, and consequently, electrostatic image forming means having a long focal length (of the laser beam system or the like) is required. Thus, there is another problem that the entire electrophotographic apparatus body inevitably has a great size. It is to be noted that a technique similar to such conventional electrophotographic apparatus is disclosed in Japanese Patent Publication No. 58506/1987.

SUMMARY OF THE INVENTION

The present invention has been made to eliminate such problems as described above, and it is a principal object of the present invention to provide an electrophotographic apparatus wherein a clear image can be formed on a surface of a photosensitive drum in a processing unit removably disposed in an electrophotographic apparatus body by electrostatic image forming means provided outside the processing unit.

It is another object of the present invention to provide an electrophotographic apparatus wherein the distance between electrostatic image forming means and a photosensitive drum disposed in a processing unit removably mounted on an electrophotographic apparatus body can normally be kept at a predetermined value with a high degree of accuracy.

It is a further object of the present invention to provide an electrophotographic apparatus wherein an electrophotographic apparatus body can be formed in a small size.

It is a still further object of the present invention to provide an electrophotographic apparatus wherein the distance between a photosensitive drum and electrostatic image forming means can normally be kept at a predetermined value with a high degree of accuracy by simple and inexpensive means without employing a complicated, expensive device.

In order to attain the objects, according to the present invention, there is provided an electrophotographic apparatus which comprises a first holding member on which electrostatic image forming means is mounted for pivotal motion toward and away from a photosensitive drum, positioning means mounted on the first holding member and having an end adapted to contact with the photosensitive drum to position the electrostatic image forming means with respect to the photosensitive drum, and a second holding member provided for pivotal motion on the first holding member by way of a spring, the second holding member urging the first holding member toward the photosensitive drum by way of the spring by means of a cam on the fixed side of an electrophotographic apparatus body when the opening and closing movable side of the electrophotographic apparatus body is in a closed condition.

The above and other objects, features and advantages of the present invention and the manner of realizing them will become more apparent, and the invention itself will best be understood, from a study of the following description and appended claims with reference had to the attached drawings showing some preferred embodiments of the invention. However, the drawings are only for the illustration but not of the nature limiting the scope of the invention.

DETAILED DESCRIPTION OF THE PREFERRED EMBODIMENTS

In the following, preferred embodiments of the present invention will now be described in detail referring to the accompanying drawings.

Figure 1:
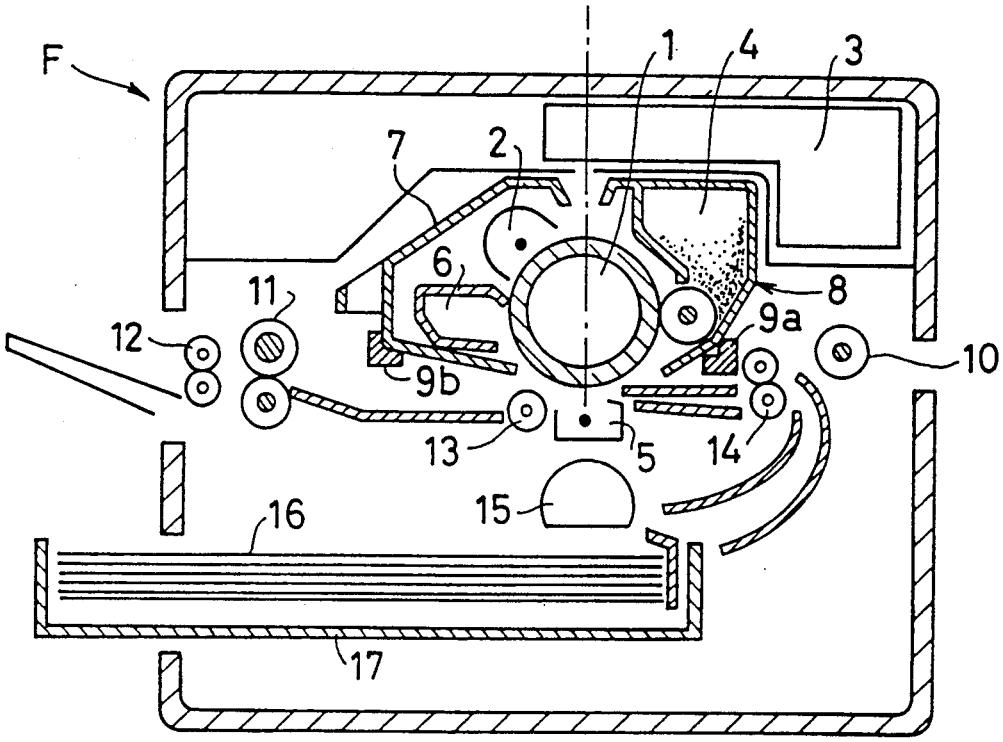
FIG. 1 (PRIOR ART)
FIG. 1 is a vertical sectional view showing a conventional electrophotographic apparatus.
Figure 2:
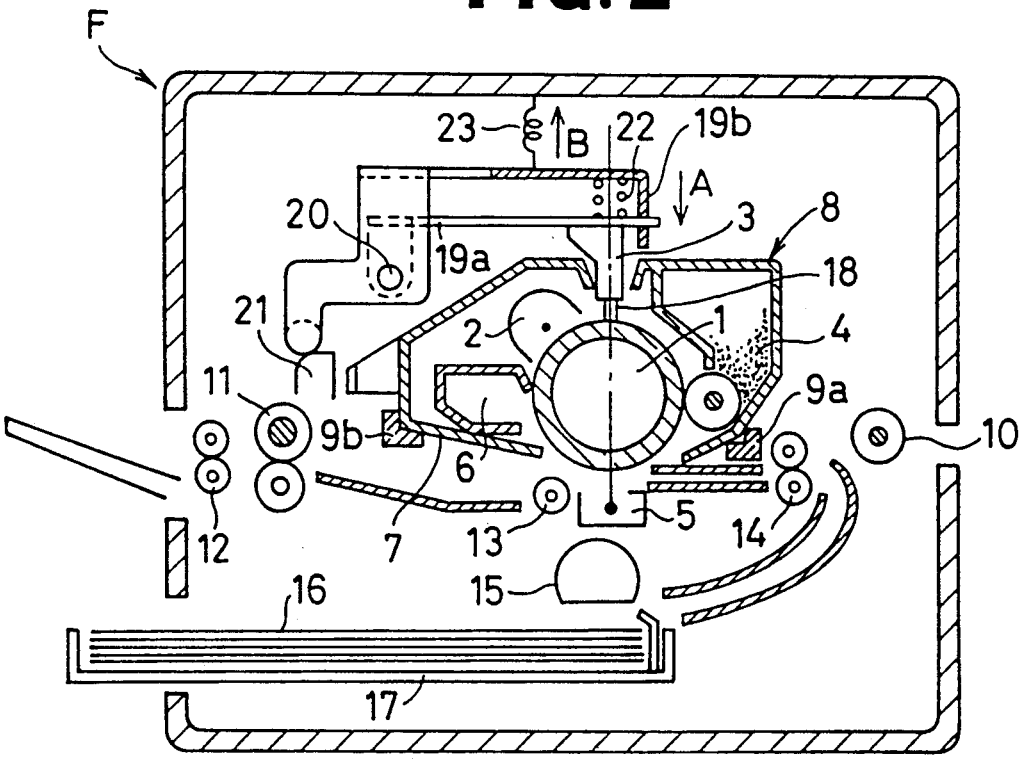
FIG. 2 is a vertical sectional view showing an electrophotographic apparatus according to an embodiment of the present invention.

Referring to FIG. 2, reference numeral 18 denotes a positioning pin serving as positioning means provided on electrostatic image forming means 3. The positioning pin 18 has a smoothly worked end which functions to contact with and slidingly move on a surface of a photosensitive drum 1 to focus the electrostatic image forming means 3 on the photosensitive drum 1. Reference characters 19*a* and 19*b* denote an upper first holding member and a lower second holding member, respectively, for holding the electrostatic image forming means 3 thereon. Reference numeral 20 denotes a rotational fulcrum common to the holding members 19*a* and 19*b*, 21 a positioning cam provided on an electrophotographic apparatus body F for engaging with a base end of the holding member 19*b* to position the holding member 19*b*, and 22 a spring for urging the electrostatic image forming means 3 mounted on the holding member 19*a* in the direction indicated by an arrow mark A. Reference numeral 23 denotes a spring for urging the electrostatic image forming means 3 upwardly in the direction indicated by an arrow mark B around the rotational fulcrum 20 by way of the holding members 19*a* and 19*b*. It is to be noted that like parts or elements are denoted by like reference characters to those shown in FIG. 1, and overlapping description thereof will be omitted herein.

Operation of this apparatus according to an embodiment will be described. In order to form an electrostatic image, the surface of the photosensitive drum 1 is first charged uniformly with a predetermined polarity by the corona discharger 2. Then, the photosensitive drum 1 is exposed to light by the electrostatic image forming means 3 to form an electrostatic latent image thereon. In this instance, since the electrostatic image forming means 3 is held in contact with the photosensitive drum 1 by the urging force exerted in the direction indicated by the arrow mark A by the spring 22 by way of the positioning pin 18, even if the photosensitive drum 1 rotates eccentrically, the electrostatic image forming means 3 will follow the photosensitive drum 1 in accordance with such eccentric condition to maintain a proper focal distance thereof. As a result, an electrostatic latent image is formed clearly on the photosensitive drum 1. The thus formed electrostatic latent image is developed into a visible image by the developing device 4. The visible image thus obtained with developer is transferred by the transfer corona discharger 5. In particular, record paper sheets 16 contained in the record paper cassette 17 are forwarded one by one by rotational motion of the pickup roller 15 and transported to the transfer station by way of the register roller 14. A record paper sheet 16 to which the visible image has been transferred is then separated from the photosensitive drum 1 by the separating roller 13 and then fed to the fixing device 11 at which the transferred visible image is fixed to the record paper sheet 16, whereafter the record paper sheet 16 is discharged outside the electrophotographic apparatus body by the discharging roller 12.

Figure 3:
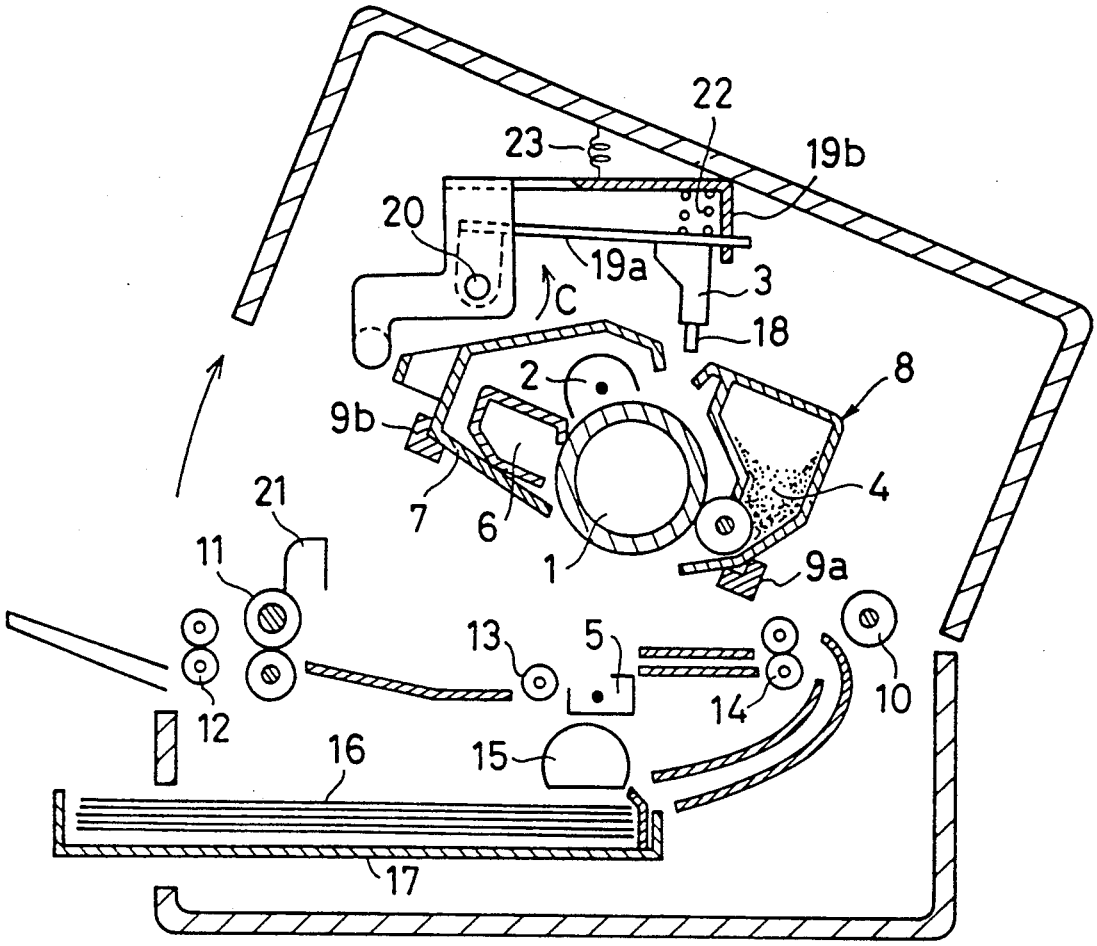
FIG. 3 is a vertical sectional view showing an open condition of an electrophotographic apparatus body of the electrophotographic apparatus shown in FIG. 2.

FIG. 3 shows the electrophotographic apparatus body F shown in FIG. 2 but in an open condition around the rotary shaft 10 As seen from FIG. 3, a base end portion of the holding member 19*b* is spaced away from the positioning cam 21, and the holding member 19*b* is pivoted in the direction indicated by an arrow mark C by a tensile force of the spring 23 around the rotary fulcrum 20 to move the electrostatic image forming means 3 upwardly by way of the holding member 19*a*. As a result, the processing unit 8 and the electrostatic image forming means 3 no more interfere with each other, and the processing unit 8 can be mounted or removed in a longitudinal direction of the electrostatic image forming means 3 which coincides with a direction perpendicular to the plane of FIG. 3.

Figure 4:
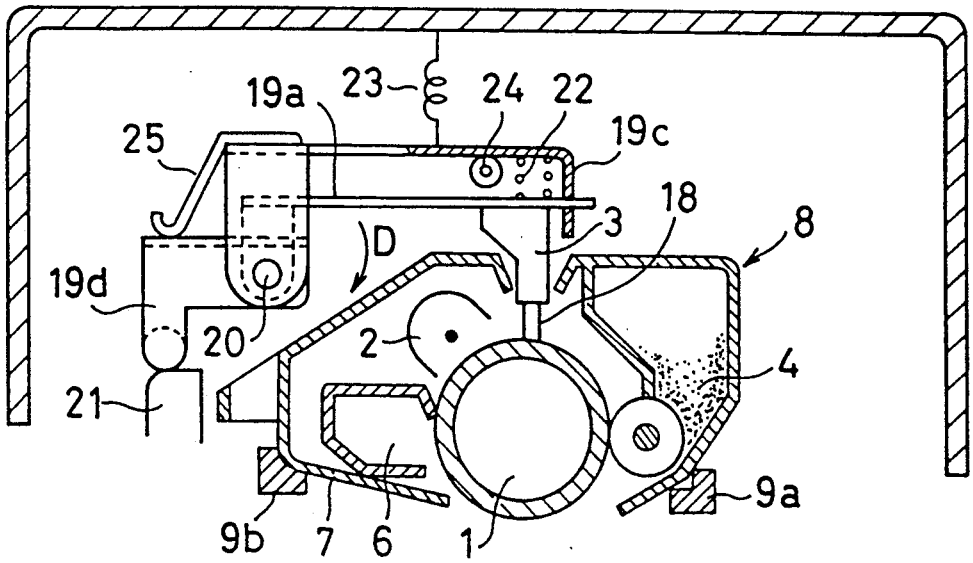
FIG. 4 is a vertical sectional view showing an electrophotographic apparatus according to another embodiment of the present invention.

It is to be noted that, while the holding member 19*b* is positioned with respect to the photosensitive drum 1 by the positioning cam 21 in the embodiment described above, since the positioning cam 21 is provided on the fixed side of the electrophotographic apparatus body while the processing unit 8 is provided on the opening and closing movable side, time is required more or less to establish appropriate relative positions of the holding member 19*b* and the processing unit 8 due to accumulation of assembly errors. Further, it may possibly occur that the holding member 19*b* and the processing unit 8 are displaced out of the appropriate relative positions and consequently the urging force to the photosensitive drum 1 by the spring 22 is varied. Thus, in order to solve such adjusting time as described above, the holding member 19*b* of FIG. 2 is divided into two holding members 19*c* and 19*d* as shown in FIG. 4, and the holding member 19*c* is urged in the direction indicated by an arrow mark D by a leaf spring 25 to press against the positioning cam 21 by way of the holding member 19*d*. As a result, the holding member 19*c* is contacted with and positioned by the positioning pin 24 provided on the movable side of the electrophotographic apparatus body in the neighborhood of the processing unit 8, and consequently, such accumulation of assembly errors as described above is eliminated and adjustment becomes unnecessary. Here, the relationship of torque with regard to the rotational fulcrum 20 is given by $$Tc > Ta + Tb$$

where Ta is torque which is exerted by the spring 22. Tb is torque exerted by the spring 23, and Tc is torque exerted by the leaf spring 25.

Further, while the electrostatic image forming means 3 is urged by the spring 22 in the embodiment described above, alternatively it may be urged using a weight or by the weight of the electrostatic image forming means 3 itself.

Further, while the force acting in the direction indicated by the arrow mark B is exerted by the spring 23 in the embodiment described above, a torsion spring may alternatively be employed, and similar effects as in the embodiment described above are exhibited.

Figure 5:
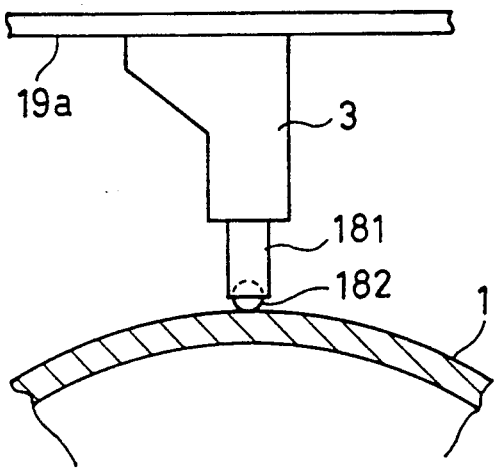
FIGS. 5 and 6 are partial views of second and third embodiments, respectively, of positioning means according to the present invention.
Figure 6:
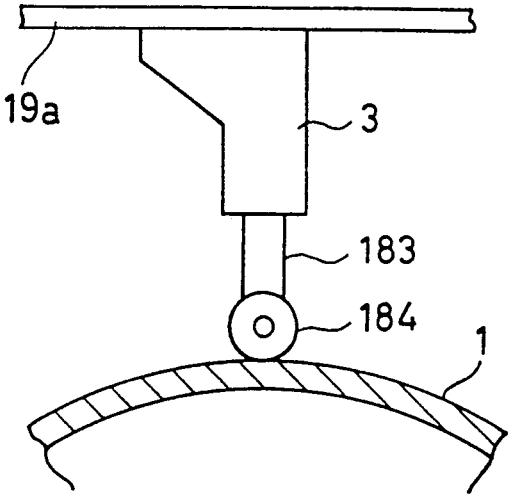

FIGS. 5 and 6 are partial views showing second and third embodiments of the positioning means.

Referring to FIG. 5, reference numeral 181 denotes a support member provided for the electrostatic image forming means 3, and 182 a rotary body carried for rolling movement at an end of the support member 181. The rotary body 182 contacts with the surface of the photosensitive drum 1 and is rolled by rotation of the photosensitive drum 1.

Referring to FIG. 6, reference numeral 183 denotes a support shaft provided on the electrostatic image forming means 3, and 184 a roller member supported for rotation at an end of the support shaft 183. The roller member 184 contacts with the surface of the photosensitive drum 1 and is rotated by rotation of the photosensitive drum 1.

Figure 7:
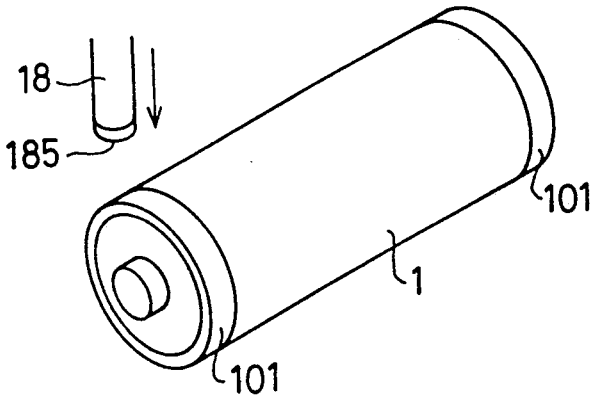
FIG. 7 is a partial perspective view showing a fourth embodiment of positioning means according to the present invention.

FIG. 7 is a perspective view showing a fourth embodiment of the positioning means.

Referring to FIG. 7, reference numeral 101 denotes a low friction slidable member provided in an integrated relationship at a predetermined location of the photosensitive drum 1, and 185 a low friction sliding member provided in an integrated relationship at an end of the positioning pin. The low friction sliding member 185 at the end of the positioning pin 18 contacts with the low friction slidable member 101 serving as a contacting portion of the photosensitive drum 1 and slidably moves on the low friction slidable member 101 when the photosensitive drum 1 rotates.

Figure 8:
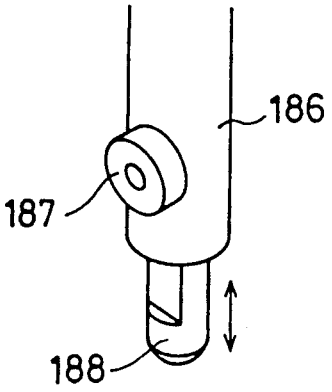
FIG. 8 is a partial perspective view showing a fifth embodiment of positioning means according to the present invention.

FIG. 8 is a perspective view showing a fifth embodiment of the positioning means.

Referring to FIG. 8, reference numeral 186 denotes a support sleeve provided on the electrostatic image forming means 3, 187 a fastening screw provided at a predetermined location of the support sleeve 186, and 188 an adjusting element secured to an arbitrary location of the support sleeve 186 by the fastening screw 187 for movement in a hollow portion of the support sleeve 186. The adjusting element 188 naturally has contacting means for contacting with the contacting portion of the photosensitive drum 1 described above. The adjusting element 188 is secured at a desired location to the support sleeve 186 by the fastening screw 187 so that the electrostatic image forming means 3 is arbitrarily positioned at a desired location adjacent the photosensitive drum 1.

As described above, according to the present invention, positioning means is mounted on a first holding member on which electrostatic image forming means is provided, and the positioning means is contacted with a photosensitive drum so as to set the relative position of the electrostatic image forming means to the photosensitive drum. Further, a second holding member is provided for pivotal motion on the first holding member by way of a spring such that it urges the first holding member toward the photosensitive drum by way of the spring by means of an internal cam when the electrophotographic apparatus body is in a closed condition. Accordingly, even if opening and closing operation of the electrophotographic apparatus is repeated, or even if the photosensitive drum becomes eccentric or a mounting error of various parts takes place, such error is absorbed by the spring and the relative position of the electrostatic image forming means to the photosensitive drum can always be kept constant, and consequently, a record picture of a high quality can be obtained. Further, there is an effect that electrostatic image forming means having a short focal length distance such as, for example, electrostatic image forming means of the LED type can be employed by making the length of the positioning means adjustable.

What is claimed is:

1. An electrophotographic apparatus which includes a corona discharger for charging a surface of a photosensitive drum uniformly, electrostatic image forming means for exposing said photosensitive drum thus charged to light to form a latent image on said photosensitive drum, and a transfer device for transferring to record paper a developed image obtained by development of the latent image by means of a developing device, comprising a first holding member on which said electrostatic image forming means is mounted for pivotal motion toward and away from said photosensitive drum, positioning means mounted on said first holding member and having an end adapted to contact with said photosensitive drum to position said electrostatic image forming means with respect to said photosensitive drum, and a second holding member provided for pivotal motion on said first holding member by way of a spring, said second holding member urging said first holding member toward said photosensitive drum by way of said spring by means of a cam on the fixed side of an electrophotographic apparatus body when the opening and closing movable side of said electrophotographic apparatus body is in a closed condition.

2. An electrophotographic apparatus according to claim 1, wherein said positioning means is a positioning pin having a smoothly worked end portion adapted to contact with said surface of said photosensitive drum.

3. An electrophotographic apparatus according to claim 1, wherein said positioning means is a rotary body adapted to contact with and be rolled by said surface of said photosensitive drum, and a support member for holding said rotary body thereon.

4. An electrophotographic apparatus according to claim 3, wherein said rotary body of said positioning means is roller means which is supported for rotation at an end of said support member and adapted to contact with and be rotated by said surface of said photosensitive drum.

5. An electrophotographic apparatus according to claim 1 or 2, wherein a low friction member is provided in an integrated relationship at a contacting portion of said surface of said photosensitive drum at which said positioning means contacts and/or the contacting portion of said positioning means.

6. An electrophotographic apparatus according to claim 1, wherein said positioning means is mounted for adjustment in length on said first holding member to arbitrarily set the distance between said electrostatic image forming means and said photosensitive drum.

7. An electrophotographic apparatus according to claim 1, wherein said second holding member is divided so as to be composed of an engaging portion for engaging with said cam and an urging portion for urging said first holding member toward said photosensitive drum.

* * * * *

UNITED STATES PATENT AND TRADEMARK OFFICE

CERTIFICATE OF CORRECTION

PATENT NO. : 5,089,846

DATED : February 18, 1992

INVENTOR(S) : Hiroshi Tabuchi

It is certified that error appears in the above-identified patent and that said Letters Patent is hereby corrected as shown below:

On the title page, Item [54]:

--ELECTROPHOTOGRAPHIC APPARATUS WITH POSITIONING OF ELECTROSTATIC IMAGE FORMING DEVICE RELATIVE TO DRUM--.

In the Abstract:

Lines 2&3, change "Electrostatic" to --An electrostatic--; delete "according to the present invention";

UNITED STATES PATENT AND TRADEMARK OFFICE

CERTIFICATE OF CORRECTION

PATENT NO. : 5,089,846

DATED : February 18, 1992

INVENTOR(S) : Hiroshi Tabuchi

It is certified that error appears in the above-identified patent and that said Letters Patent is hereby corrected as shown below:

Column 3, line 33, change "on" to --along--;

Column 4, line 30, change "more" to --longer-.

In the Claims:

Column 6, lines 14-36

--1. (amended) An electrophotographic apparatus which includes an apparatus body having a fixed section and a movable section, a corona discharger for charging a surface of a photosensitive drum uniformly, electrostatic image forming means for exposing said photosensitive drum thus charged to light to form a latent image on said photosensitive drum, and a transfer device for transferring to record paper a developed image obtained by development of the latent image by means of a developing device, comprising:

a first holding member on which said electrostatic image forming means is mounted for pivotal motion toward and away from said photosensitive drum[,];

positioning means mounted on said electrostatic image forming means [first holding member] and having an end adapted to contact [with] said photosensitive drum to position said electrostatic image forming means with respect to said photosensitive drum[,]; [and]

a second holding member provided for pivotal motion on said first holding member by way of a spring, said second holding member including means for urging said first holding member toward said photosensitive drum; and [by way of said spring by means of a]

UNITED STATES PATENT AND TRADEMARK OFFICE

CERTIFICATE OF CORRECTION

PATENT NO. : 5,089,846

DATED : February 18, 1992

INVENTOR(S) : Hiroshi Tabuchi

It is certified that error appears in the above-identified patent and that said Letters Patent is hereby corrected as shown below:

a cam provided in said [on the] fixed section [side] of said [an] electrophotographic apparatus body which contacts said means for urging when the [opening and closing] movable section [side] of said electrophotographic apparatus body is in a closed condition.--

Claim 6, line 60. change "first holding member" to --electrostatic image forming means--;

Column 6,
Claim 7, lines 14&65, change "second holding member" to --means for urging--; delete "divided so as to be"

Signed and Sealed this

Seventh Day of December, 1993

Attest:

Attesting Officer

Bruce Lehman

BRUCE LEHMAN

Commissioner of Patents and Trademarks